US005094452A

United States Patent [19]

Hennigan

[11] Patent Number: 5,094,452

[45] Date of Patent: Mar. 10, 1992

[54] GOLF GLOVE WITH A DISTANCE ESTIMATOR

[76] Inventor: George Hennigan, 1521 Squirrel Tree Pl., Edmond, Okla. 73034

[21] Appl. No.: 392,034

[22] Filed: Aug. 9, 1989

[51] Int. Cl.[5] ..... A63B 57/00

[52] U.S. Cl. ..... 273/32 H; 273/162 R; 273/162 F

[58] Field of Search ..... 273/32 H, 162 B, 162 F, 273/163 A, 166; 2/16, 17, 159, 161 A, 160, 163; 33/277, 508

[56] References Cited

U.S. PATENT DOCUMENTS

| | | | |
|---|---|---|---|
| D. 194,040 | 11/1962 | Schroeder . | |
| 2,519,727 | 8/1950 | Yezdan | 33/277 |
| 3,186,092 | 6/1965 | Bertas . | |
| 3,193,933 | 7/1965 | Frey | 33/277 |
| 3,409,987 | 11/1968 | New . | |
| 3,824,698 | 7/1974 | Brucker | 273/32 H |
| 3,846,918 | 11/1974 | Wehlau | 33/277 |
| 3,848,874 | 11/1974 | Elkins, Jr. | 273/166 |
| 3,907,288 | 9/1975 | Hudak . | |
| 3,965,488 | 6/1976 | Paulucci . | |
| 3,977,086 | 8/1976 | Williams, Jr. . | |
| 4,063,731 | 12/1977 | Kitay . | |
| 4,082,286 | 4/1978 | La Breche . | |
| 4,211,415 | 7/1980 | Lindo . | |
| 4,281,389 | 7/1981 | Smith . | |

*Primary Examiner*—Edward M. Coven
*Assistant Examiner*—Raleigh W. Chiu
*Attorney, Agent, or Firm*—Dunlap, Codding, Peterson & Lee

[57] ABSTRACT

A golf glove having a base line and a plurality of yardage lines. Each of the yardage lines is spaced a predetermined distance from the base line and each yardage line is associated with a predetermined distance. The base line is alignable with a bottom portion of a golf flag and the upper end of the golf flag is alignable with one of the yardage lines wherein distance associated with the yardage line aligned with the upper end of the golf flag indicates the estimated distance between the individual and the golf flag.

6 Claims, 2 Drawing Sheets

GOLF GLOVE WITH A DISTANCE ESTIMATOR

FIELD OF THE INVENTION

The present invention relates to an improved golf glove with a base line and a plurality of yardage lines for estimating the distance between an individual user and the golf flag on a golf green.

BRIEF DESCRIPTION OF THE DRAWINGS

FIG. 3 is a diagrammatic view illustrating the operation of the golf glove of FIG. 1.

FIG. 3A is a schematic view of a right triangle for illustrating the positioning of the base line and the yardage lines of the distance estimator.

DESCRIPTION OF THE PREFERRED EMBODIMENTS

Figure 1:
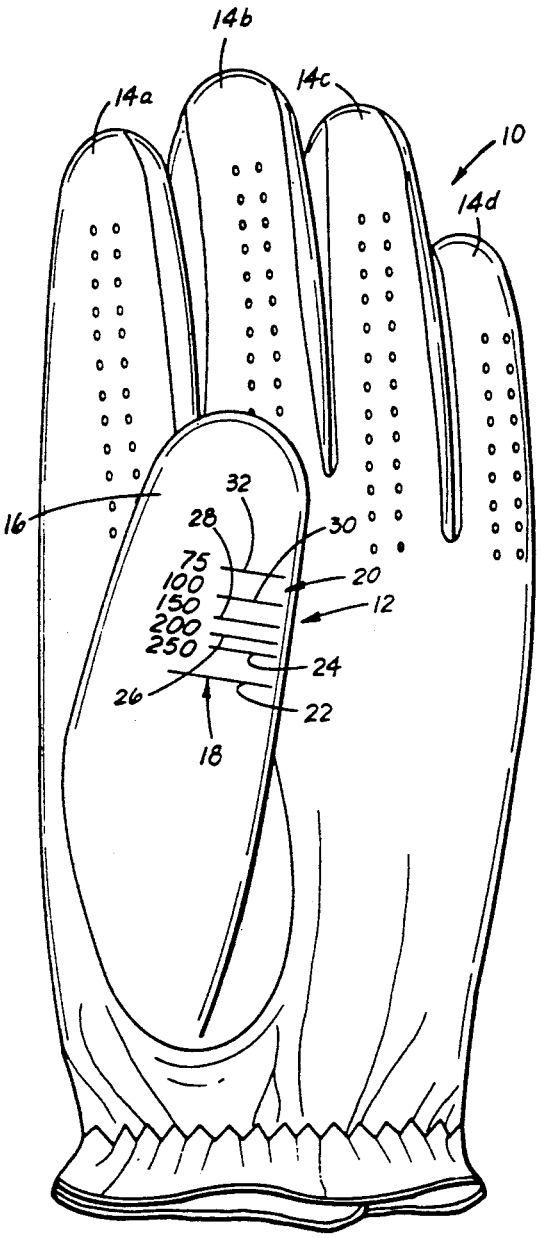
FIG. 1 is a plan view of an improved golf glove with a distance estimator on a thumb portion of the golf glove constructed in accordance with the present invention.
Figure 2:
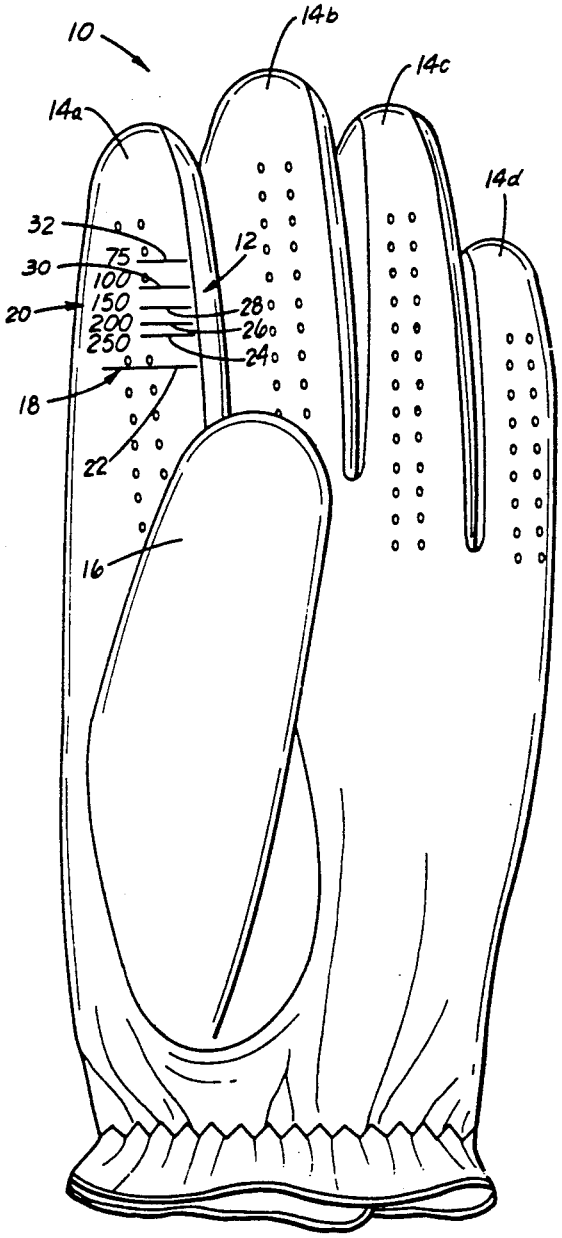
FIG. 2 is a plan view, similar to FIG. 1, but showing the distance estimate on one of the finger portions of the golf glove.
Figure 5:
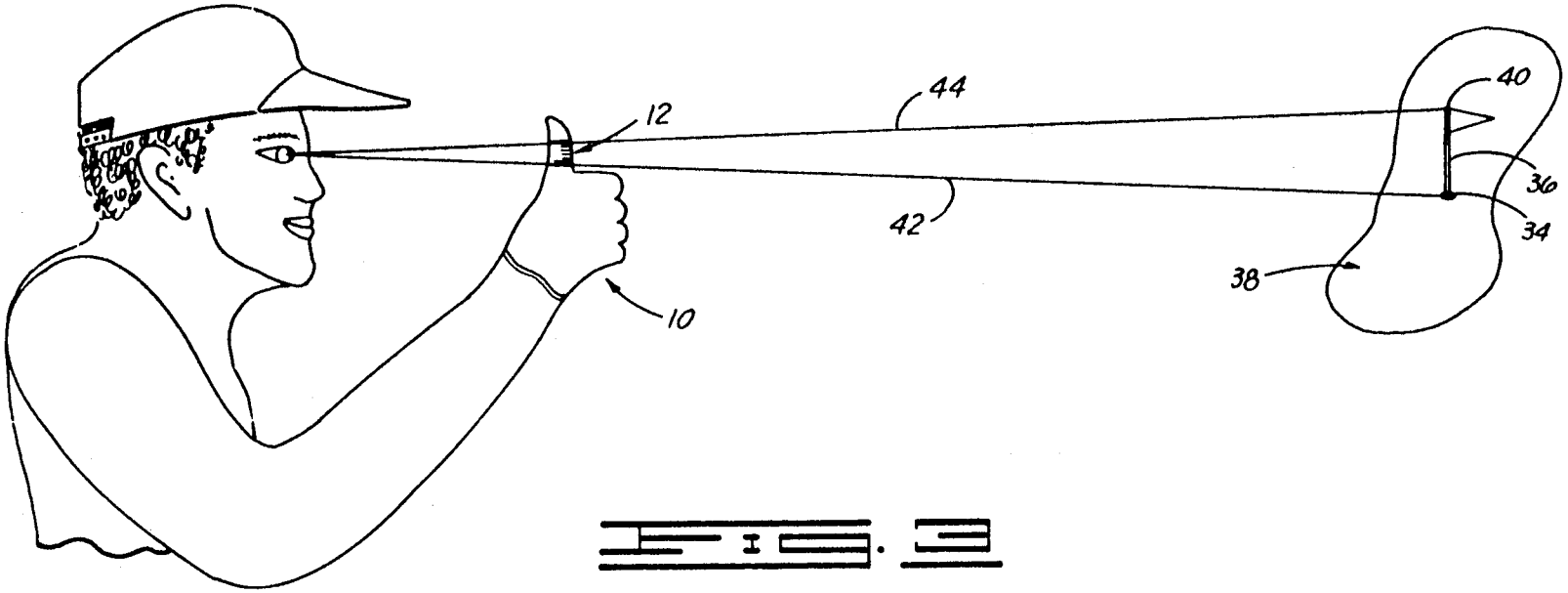
Figure 5A:
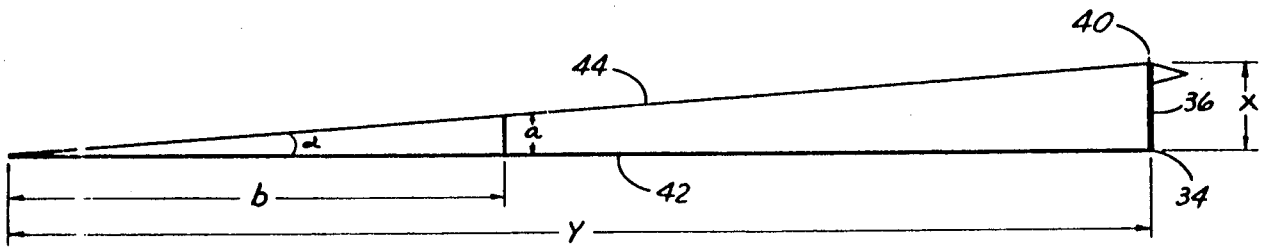

Shown in FIG. 1 and designated by the reference numeral 10 is an improved golf glove with a distance estimator 12 thereon which is constructed in accordance with the present invention.

The golf glove 10 fits over one of an individual's hands. The golf glove 10 includes finger portions 14 (each finger portion being designated by one of the reference numerals 14*a*, 14*b*, 14*c* and 14*d* in FIG. 1). Each finger portion 14 is sized and adapted to accommodate one of the individual's fingers. The golf glove 10 also includes a thumb portion 16 which is sized and adapted to accommodate the individual's thumb. Golf gloves of the type just described in connection with the golf glove 10 without the distance estimator 12 are well know in the art and are commercially available from various sources.

The distance estimator 12 comprises base line indication 18 and yardage line indication 20. The base line indication 18 comprises a base line 22 placed on the thumb portion 16 of the golf glove 10. The yardage line indication 20 comprises a plurality of yardage lines 24, 26, 28, 30 and 32.

Each yardage line 24, 26, 28, 30 and 32 is associated with a different, predetermined distance. As shown in FIG. 1, the yardage line 24 is associated with the distance 250 for indicating 250 yards, the yardage line 26 is associated with the distance 200 for indicating 200 yards, the yardage line 28 is associated with the distance 150 for indicating 150 yards, the yardage line 30 is associated with the distance 100 for indicating 100 yards, and the yardage line 32 is associated with the distance 75 for indicating 75 yards.

The golf glove 10 is adapted to be used by a golfer for estimating the distance between the golfer and the flag on the green. This information of course will assist the golfer in the proper golf club selection.

The operation of the golf glove 10 with the distance estimator 12 thereon is diagrammatically illustrated in FIG. 3. As shown in FIG. 3, an individual golfer, with the golf glove on the individual's right hand, extends the individual's arm to a position wherein the individual's arm extends generally in front of the individual with distance estimator 12 being positioned generally with the line of site of the individual. It should be noted that preferably the arm of the individual golfer is extended to a position wherein the elbow is not bent, although in FIG. 3 the elbow appears slightly bent. The individual golfer then moves the individual's hand to a position wherein the base line 22 is aligned with a bottom portion 34 of the golf flag 36 which is positioned on a golf green 38. The individual then aligns, with his eyes, an upper end 40 of the golf flag 36 with one of the yardage lines 24, 26, 28, 30 or 32. The yardage or distance associated with the yardage line 24, 26, 28, 30 or 32 which is aligned with the upper end 40 of the golf flag 36 represents the estimated distance between the individual golfer and the golf flag. For example, the upper end 40 of the golf flag 36 is aligned with the yardage line 30 associated with the distance 100 in FIG. 3, thereby indicating an estimated distance of 100 yards between the individual golfer and the golf flag 36.

As illustrated in FIG. 3, a line of site 42 between the individual's eyes and the bottom portion 34 of the golf flag 36 represents one side of a right triangle. The golf flag 36 represents one other side of the right triangle. A line of site 44 between the individual's eyes and the upper end 40 of the golf flag 36 represent the hypotenuse of the right triangle.

The right triangle just described is illustrated in FIG. 3A wherein: x=the height of the golf flag 36 above the surface of the golf green 38; y=the distance between the individual golfer and the golf flag 36; a=the distance between the base line 22 and one of the yardage lines 24, 26, 28, 30 or 32; b=the distance between the eyes of the individual golfer and position of the distance estimate or; $\alpha$=the angle between the sides of the right triangle represented by the lines of site 42 and 44.

To determine the distance "a" on the distance estimator 12 between the base line 22 and the yardage line 30 associated with the distance representing 100 yards, the distance "b" between the eye of the individual is estimated to be 30 inches and the height "x" of the golf flag 36 is estimated to be 6-½ feet and the distance "y" is know to be 100 yards. With these known or estimated values, the distance "a" is determined as follows:

$$\mathrm{TAN}\alpha = \frac{a}{b} = \frac{x}{y}$$

$$a = \left(\frac{x}{y}\right)(b)$$

$$a = \left(\frac{6.5}{300}\right)(30) = 0.650 \text{ inches } \frac{19}{32} = 0.594 \text{ in}$$

Following the above procedure, the distance between the base line and the other yardage lines 24, 26, 28 and 32 are determined. These distances are as follows:

| YARDAGE LINE | DISTANCE BETWEEN BASE LINE AND YARDAGE LINE |
|---|---|
| (250 yds) yardage line 24 | 0.260 inches |
| (200 yds) yardage line 26 | 0.325 inches |
| (150 yds) yardage line 28 | 0.433 inches |
| (100 yds) yardage line 30 | 0.650 inches |
| (75 yds) yardage line 32 | 0.867 inches |

The foregoing estimates should provide fairly good estimates of distance. The heights of golf flags are fairly uniform. The lengths of individual's arms will vary; however, an estimated distance of 30 inches is considered to provide a reasonable estimate which will yield reasonable distance determinations.

Changes may be made in the distance estimator described herein or changes may be made in the steps or the sequence of steps of the methods described herein without departing from the spirit and scope of the invention as defined in the

What is claimed is:

1. An improved golf glove adapted for use in conjunction with a golf flag disposed in a hold on a golf green for assisting an individual in estimating a distance between the individual and the golf flag wherein the golf flag has a bottom portion generally at the top of the hole and an upper end and wherein the golf glove is adapted to be worn by the individual having finger portions covering the individual's fingers and a thumb portion covering the individual's thumb, the improvement comprising:

a base line on the golf glove; and a plurality of yardage lines on the golf glove, each yardage line being spaced a predetermined distance from the base line and each yardage line being associated with a predetermined distance, the base line being alignable with one end of the golf flag and the opposite end of the golf flag being alignable with one of the yardage lines wherein the distance associated with the yardage line aligned with the golf flag indicates the estimated distance between the individual and golf flag.

2. The improvement of claim 1 wherein the base line is on the thumb portion of the golf glove and wherein the yardage lines are on the thumb portion of the golf glove.

3. The improvement of claim 1 wherein the base line is on one of the finger portions of the golf glove and wherein the yardage lines are on the one of the finger portions of the golf glove.

4. A method for making a golf glove adapted for use in conjunction with a golf flag disposed in a hole on a golf green for assisting an individual in estimating a distance between the individual and the golf flag wherein the golf flag has a bottom portion generally at the top of the hole and an upper end and wherein the golf glove is adapted to be worn by the individual having finger portions covering the individual's fingers and a thumb portion covering the individual's thumb, the method comprising:

placing a base line on the golf glove; and placing a plurality of yardage lines on the golf glove, each yardage line being spaced a predetermined distance from the base line and each yardage line being associated with a predetermined distance, the base line being alignable with one end of the golf flag and the opposite end of the golf flag being alignable with one of the yardage lines wherein the distance associated with the yardage line aligned with the one end of the golf flag indicates the estimated distance between the individual and golf flag.

5. The method of claim 4 wherein the base line is placed on the thumb portion of the golf glove, and wherein the yardage lines are placed on the thumb portion of the golf glove.

6. The method of claim 4 wherein the base line is placed on one of the finger portions of the golf glove, and wherein the yardage lines are placed on one of the finger portions of the golf glove.

* * * * *

UNITED STATES PATENT AND TRADEMARK OFFICE

CERTIFICATE OF CORRECTION

PATENT NO. : 5,094,452

DATED : March 10, 1992

INVENTOR(S) : George Hennigan

It is certified that error appears in the above-identified patent and that said Letters Patent is hereby corrected as shown below:

Column 3, line 12, the following words should be added after the word, the: --following claims--.

Column 3, line 15, the word "hold" should be --hole--.

Signed and Sealed this

Fourteenth Day of September, 1993

Bruce Lehman

*Attest:*

BRUCE LEHMAN

*Attesting Officer*

*Commissioner of Patents and Trademarks*